United States Patent [19]

Harston et al.

[11] Patent Number: 4,881,934

[45] Date of Patent: Nov. 21, 1989

[54] ROTARY TRANSFER MECHANISM

[75] Inventors: John C. Harston, Avon; Colin P. Ford, Bristol, both of England

[73] Assignee: Kliklok Corporation, Decatur, Ga.

[21] Appl. No.: 316,505

[22] Filed: Feb. 27, 1989

[30] Foreign Application Priority Data

Feb. 27, 1988 [GB] United Kingdom ..... 8804637

[51] Int. Cl.[4] ..... B65H 3/08; B31B 1/80

[52] U.S. Cl. ..... 493/315; 493/318; 271/95; 271/31.1; 271/107; 414/736; 414/737; 414/798.9

[58] Field of Search ..... 493/315, 316, 317, 318, 493/479; 414/798.9, 736, 737; 271/95, 99, 107, 31.1

[56] References Cited

U.S. PATENT DOCUMENTS

| | | | |
|---|---|---|---|
| 2,915,308 | 12/1959 | Matzen . | |
| 2,936,681 | 5/1960 | Earp | 493/315 |
| 3,302,946 | 2/1967 | Anderson . | |
| 3,575,409 | 4/1971 | Calvert . | |
| 3,836,139 | 9/1974 | Shimizu | 271/95 |
| 3,937,458 | 2/1976 | Langen . | |
| 4,194,442 | 3/1980 | Martelli | 493/315 |
| 4,350,466 | 9/1982 | Bahr et al. . | |
| 4,735,600 | 4/1988 | Drewke et al. | 493/315 |

*Primary Examiner*—Frederick R. Schmidt
*Assistant Examiner*—Jack Lavinder
*Attorney, Agent, or Firm*—King and Schickli

[57] ABSTRACT

A rotary transfer mechanism has carrier means (18) rotatable with a drive shaft (16) on a support member (15), at least one support shaft (19) rotatable on the carrier means (18), with a pinion (24) secured coaxially to the support shaft and engageable with an arcute rack (25) secured to the support member (15) when a cam follower (26) is not engaged with a cam track (27) secured to the support member, whereby at least one suction cup (21) attached to the support shaft (19) is caused to follow a path having a "node point" at the discharge opening (11) of a magazine (12), for extracting a flat sleeve carton (10), and whereby the suction cup (21) is caused to move past a receiving station (13) on a conveyor (14) in the same direction as the conveyor with the carton (10) generally parallel to the conveyor, for accurate placement and deposit of the carton on the conveyor.

11 Claims, 7 Drawing Sheets

ROTARY TRANSFER MECHANISM

BACKGROUND OF THE INVENTION

This invention relates to a rotary transfer mechanism for extracting a flat article from the discharge opening of a magazine and depositing it at a receiving station.

Such mechanisms are known to comprise a support member, a drive shaft rotatably mounted on and extending from the support member, means for rotatably driving the drive shaft, carrier means rotatable with the drive shaft, at least one support shaft rotatable on the carrier means substantially parallel to the drive shaft, whereby the support shaft can orbit round the drive shaft, means for controlling the rotational disposition of the support shaft with respect to the carrier mean, at least one suction cup attached to the support shaft, means for producing a vacuum, means alternatively connecting the suction cup with the vacuum-producing means and the atmosphere, the means for controlling the support shaft including means causing the suction cup while connected with the vacuum-producing mean to contact an article at the discharge opening of the magazine, extract the article from the magazine, and transfer the article to the receiving station, whereupon the suction up is connected with the atmosphere to release the article to the receiving station.

In one such mechanism (U.S. Pat. No. 2 915 308) three support shafts with suction cups are spaced from and around the drive shaft on radial arms rotatable with and by the drive shaft, and the means for controlling the rotational disposition of the support shafts with respect to the carrier means consists of drive gears secured one to each support shaft, idler gears rotatably carried one by each of the arms and meshing one with each drive shaft, the idler gears also meshing with a stationary gear coaxial with the drive shaft, whereby the suport shafts rotate continuously in the opposite direction to the drive shaft, and the gear ratios of the planetary gearing comprised of the stationary gear (i.e. the sun gear), an idler gear, and the respective drive gear (i.e., a planet gear) being such that for each revolution of the drive shaft each suction cup moves along a hypotrochoidal path having three node points 120° apart, with one node point at the discharge opening of the magazine and another node point at the receiving station.

Another example is to be found in U.S. Pat. No. 3 302 946 in which the mechanism is similar to that of U.S. Pat. No. 2 915 308 with the exception that it employs a chain drive in place of the idler gears.

In another such mechanism (U.S. Pat. No. 4 350 466) four support arms with suction cups are spaced from and around the drive shaft on radial arms rotatable with and by the drive shaft, and the means for controlling the rotational disposition of the support shafts with respect to the carrier means consists of sprockets secured one to each support shaft and a plurality of pins attached to the support member and extending substantially parallel to the support shafts in a circle concentric with the drive shaft, the sprockets engaging the pins for rolling along the interior of the circle of pins, whereby the support shafts rotate continuously in the opposite direction to the drive shaft, the gear ratios of the planetary gearing comprised of the circle of pins and the sprockets being such that for each revolution of the drive shaft each suction cup moves along a hypotrochoidal path having three node points 120° apart, with one node point at the discharge opening of the magazine and another node point at the receiving station.

Similar mechanisms each with a single support shaft but with diametrically oppositely directed suction cups each following a hypotrochoidal path are to be found in U.S. Pat. No. 3 937 458 and U.S. Pat. No. 4 537 587 (EP-PS 0 134 628) transferring cartons from a magazine to a receiving station on a conveyor. A difficulty encountered by the mechanism of U.S. Pat. No. 3 937 458 is that opening of a flat sleeve carton during extraction from the magazine is resisted by the vacuum generated within the carton as the inner surfaces of the carton are being pulled apart. Therefore, in U.S. Pat. No. 4 537 587 the third node point is disposed adjacent a stationary suction cup for cooperation with each moving suction cup to open a flat sleeve carton carried thereon ready for deposit between flights on the conveyor, which flights may hold the sleeve carton open for end loading with a product at a subsequent station along the conveyor.

All these known mechanisms depend on a strict drive ratio, whether via planetary gears or chains, or sprockets nd pins, e.g., 3:1 giving three node points 120° apart, which in turn determines that the discharge opening of the magazine shall be at substantially 120° to the receiving station. Any departure from this ratio must be either to 2:1 or to 4:1, resulting in an inconvenient disposition of the discharge opening parallel to and above the receiving station, or perpendicular to the receiving station and thereby imposing severe limitation on the length of article that can be transferred.

Furthermore, when the receiving station is on a conveyor, as in U.S. Pat. No. 3 937 458 in which a single support shaft carries diametrically oppositely directed suction cups following a hypotrochoidal path, the suction cup depositing an article has substantially no component of movement in the direction of movement of the conveyor, so the instant of release of the article from the suction cup (by connection of that suction cup with the atmosphere) must be very precisely timed.

Moreover, when the article is a flat sleeve carton to be deposited open between flights on the conveyor there is a tendency for the carton to be re-flattened and/or damaged and/or rotationally displaced between the flights of the conveyor, especially if the carton is of the type having a substantially square cross-section.

In an alternative form of mechanism (U.S. Pat. No. 3 575 409) the problem of strict drive ratios, and consequentially restricted article length and angular disposition of the discharge opening of the magazine, is avoided by mounting each of three suction cups on a radially guided arm the radial and angular disposition of which is controlled by a continuous cam surface and a pair of cam followers, the cam surface being concentric with the drive shaft except over the extent of a pair of outwardly protruding segments which create a "node point" in the path of each suction cup at the magazine location while the remainder of the path of each suction cup is a circular sweep including past the receiving station. This mechanism has not been applied in any attempt to overcome to the difficulties encountered in opening a sleeve carton and maintaining its integrity of shape and correct disposition between flights on a conveyor. Object and Summary of the Invention An object of the present invention is to provide an improved, yet simple, rotary transfer mechanism for extracting a flat article from the discharge opening of a magazine and depositing it with accurate placement at a receiving station on a conveyor.

Another object is to provide a rotary transfer mechanism with which the disposition of the discharge opening of a magazine in relation to a receiving station, particularly on a conveyor, can be varied infinitely.

A further object of the invention is to provide a rotary transfer mechanism adaptable to a wide range of lengths of flat articles to be transferred from a magazine to a receiving station, particularly on a conveyor.

Yet another object is to provide a rotary transfer mechanism for transferring flat sleeve cartons from the discharge opening of a magazine to a receiving station on a conveyor having flights and for facilitating opening of the cartons ready for end loading with a product at a subsequent station along the conveyor.

According to the present invention, a rotary transfer mechanism for extracting a flat article from the discharge opening of a magazine and depositing it at a receiving station on a conveyor comprises a support member, a drive shaft rotatably mounted on and extending from the support member, means for rotatably driving the drive shaft, carrier means rotatable with the drive shaft, at least one support shaft rotatable on the carrier means substantially parallel to the drive shaft, whereby the support shaft can orbit round the drive shaft, means for controlling the rotational disposition of the support shaft with respect to the carrier means, at least one suction cup attached to the support shaft, means for producing a vacuum, means alternatively connecting the suction cup with the vacuum-producing means and the atmosphere, the means for controlling the support shaft including means causing the suction cup while connected with the vacuum-producing means to contact an article at the discharge opening of the magazine, extract the article from the magazine, and transfer the article to the receiving station, whereupon the suction cup is connected with the atmosphere to release the article to the receiving station, characterised in that the means for controlling the at least one support shaft comprises: on the one hand, a pinion secured coaxially to the support shaft, and an arcuate rack secured to the support member in such a position as to act upon the pinion to create a partial path of the at least one suction cup with a "node point" at the discharge opening of the magazine; and, on the other hand, a cam follower on an arm extending laterally from the support shaft, and a cam track secured to the support member and of such an operative extent as to act upon the cam follower when the arcuate rack is not acting on the pinion, the profile of the cam track being such as to cause the suction cup to move past the receiving station in the same direction as the conveyor with the article generally parallel to the conveyor.

Thus, the suction cup "plucks" each article from the magazine, but instead of merely dropping the article at the receiving station, the suction cup imparts to the article a major component of motion in the direction of movement of the conveyor, with consequent better placement of the article on the conveyor. The flexibility of design in suction cup path afforded by the combination of the ratio of the rack-and-pinion drive, the disposition of the rack, and the profile of the operative extent of the cam track, allows for a wide choice of article length and disposition of magazine, whilst avoiding interference between the magazine on the conveyor with the article while it is being transferred. This is particularly important when the conveyor has flights for the timed positioning of the articles in relation to a subsequent operation, such as when the article is a sleeve carton presented on the conveyor in open condition ready for end loading with a product at a subsequent station.

Indeed, in accordance with a feature of special significance, a rotary transfer mechanism in accordance with the invention for transferring flat sleeve cartons from the discharge opening of a magazine to a receiving station on a conveyor having flights, facilitates opening of the cartons ready for end loading with a product at a subsequent station along the conveyor, by arranging for the combined action of the means for rotatably driving the drive shaft and the means for controlling the at least one support shaft so that at the receiving station the at least one suction cup is moving in the same direction as the conveyor relatively at a slightly greater speed, whereby the relative movement between the suction cup, holding one side of a sleeve carton, and leading flights on the conveyor, which flights are abutted by the leading corner fold of the carton, is such as to effect an opening of the carton which is substantially completed before the carton is abutted by trailing flights on the conveyor to hold the carton in its fully open condition as it passes to and through a subsequent end-loading station.

The arcuate rack may be disposed radially inwards with respect to the orbital path of the at least one support shaft, with an idler gear in permanent mesh with the pinion and adapted to mesh with the arcuate rack (during the appropriate arc of the support shaft orbit). However, the arcuate rack is preferably disposed radially outwards with respect to the orbital path of the at least one support shaft, whereby the pinion conveniently meshes directly with the arcuate rack (during the appropriate arc of the support shaft orbit), thus avoiding the need for an idler gear. The cam follower may be carried by the pinion offset from the common axis with the support shaft, whereby the pinion serves as the arm extending laterally from the support shaft, and the cam track may be continuous but be provided with an inoperative portion along which the cam follower passes with clearance when the rack is acting on the pinion.

Conveniently, three support shafts are provided with two suction cups attached to each shaft; but two, or four or more support shafts may be provided, depending on the size of the article to be transferred and/or the spacing of articles on a conveyor; and, likewise, three or more suction cups may be attached to each support shaft, depending on the size and/or weight of article to be transferred.

Further advantageous features will become evident from the following description of an embodiment of the invention, given by way of example, only with reference to the accompanying drawings, in which:

DESCRIPTION OF PREFERRED EMBODIMENTS

Figure 1:
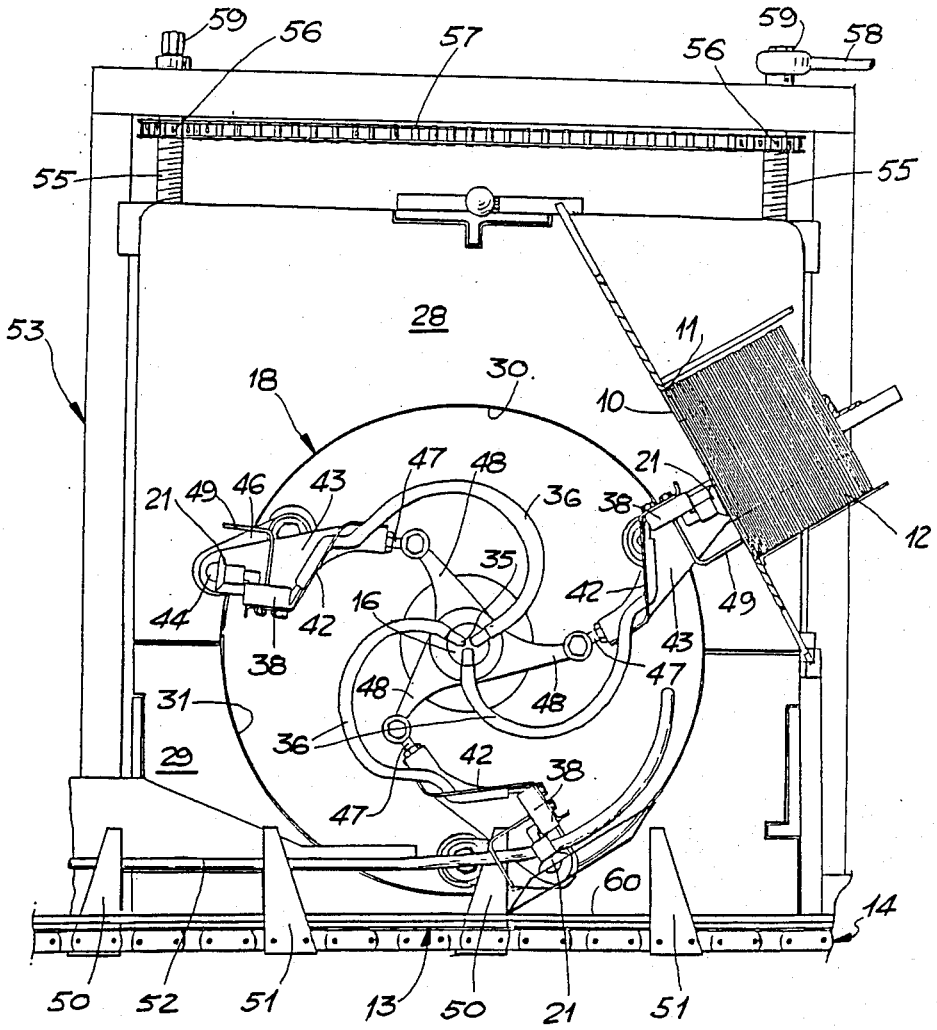
FIG. 1 is a front elevation of a rotary transfer mechanism is accordance with the invention.

Referring to FIGS. 1 to 4, the rotary transfer mechanism, for extracting a flat sleeve carton 10 from the discharge opening 11 of a magazine 12 and depositing it at a receiving station 13 on a conveyor 14 comprises a support member 15, a drive shaft 16 rotatably mounted on and extending from the support member, means 17 for rotatably driving the drive shaft, carrier means 18 rotatable with the drive shaft, three support shafts 19 rotatable on the carrier means substantially parallel to the drive shaft, whereby each support shaft can orbit round the drive shaft, means 20 for controlling the rotational disposition of each support shaft with respect to the carrier means, two suction cups 21 attached to each support shaft, means 22 for producing a vacuum, means 23 alternatively connecting the suction cups with the vacuum-producing means 22 and the atmosphere, the means 20 for controlling the support shafts including means causing the suction cups while connected with the vacuum-producing means 22 to contact a carton 10 at the discharge opening 11 of the magazine 12, extract the carton from the magazine, and transfer the carton to the receiving station 13 on the conveyor 14, whereupon the suction cups are connected with the atmosphere to release the carton 10 to the receiving station 13, characterised in that the means 20 for controlling the support shafts comprises: on the one hand, a pinion 24 secured coaxially to each support shaft 19, and an arcuate rack 25 secured to the support member 15 in such a position as to act upon the pinions to create a partial path of the suction cups 21 with a "node point" at the discharge opening 11 of the magazine 12; and, on the other hand, a cam follower 26 on an arm extending laterally from each support shaft 19 and formed by the respective pinion 24, and a cam track 27 secured to the support member 15 and of such an operative extent as to act upon each cam follower 26 when the arcuate rack 25 is not acting on the respective pinion 24, the profile of the cam track 27 being such as to cause the suction cups 21 to move past the receiving station 13 in the same direction as the conveyor 14 with the carton 10 generally parallel to the conveyor.

Figure 3:
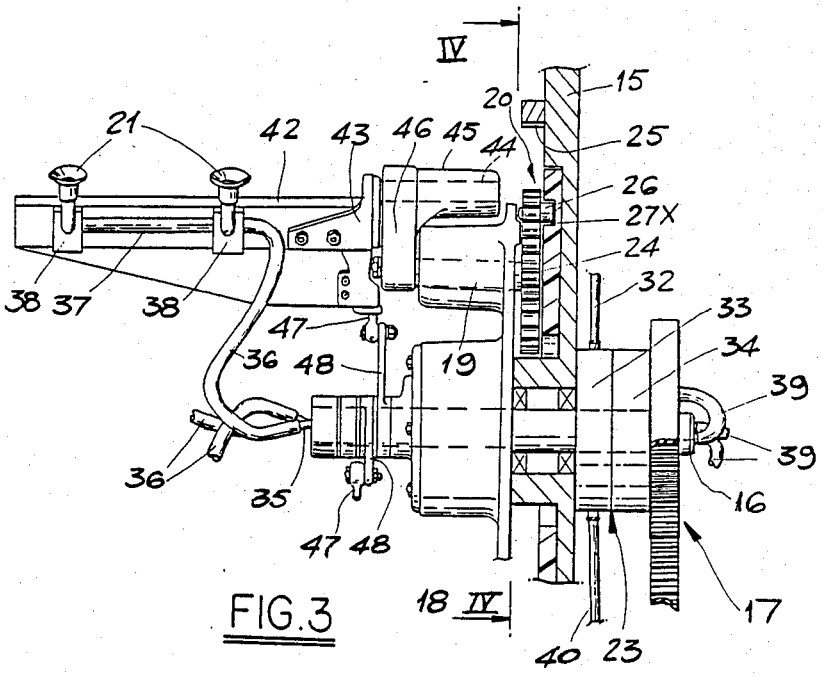
FIG. 3 is a fragmentary part-sectional elevation taken from the right-hand side of FIG. 1, on the same scale as FIG. 1.
Figure 4:
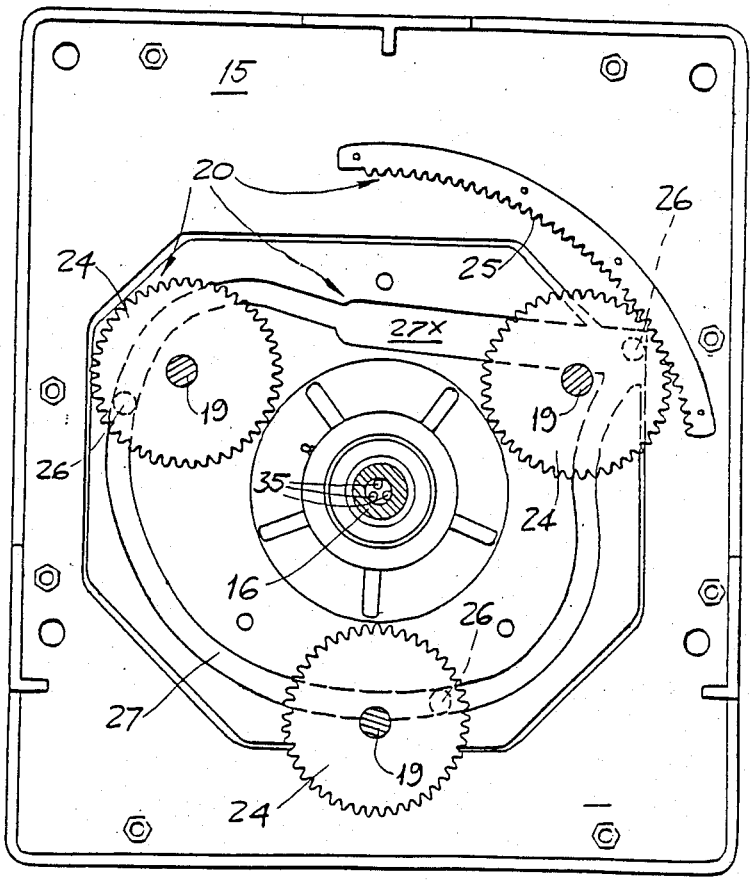
FIG. 4 is an elevation taken from the line IV—IV of FIG. 3 showing the principal features of the means for controlling the support shafts.

FIG. 1 includes cover plates 28, 29 with semicircular cut-outs 30, 31 together forming a circular opening in which the carrier means 18 rotates, the upper cover plate 28 being omitted from FIG. 3.

The vacuum-producing means 22 is a suction pump (FIG. 2) connected by a pipeline 32 to a stationary valve plate 33 (FIG. 3) of the vacuum control means 23, a rotary valve plate 34 of which is driven with the drive shaft 16. The drive shaft is hollow and contains three tubes 35, one for each pair of suction cups 21 to which connection is made by means of a flexible pipe 36 from the nearer end of the respective tube 35 to a manifold tube 37 extending through mounting blocks 38. The other end of each tube 35 is connected by a flexible pipe 39 to a port (not shown) in the rotary valve plate 34 co-operating with ports (likewise not shown) in the stationary valve plate 33 to connect the suction cups 21 as appropriate to the pipeline 32 or to a pipeline 40 to the atmosphere. An interrupter valve 41 (FIG. 2) enables suction to be withheld from cups 21 at the discharge opening 11 of the magazine 12 to prevent extraction of cartons 10 if an interruption in the delivery of product for feeding into the cartons has been detected.

Each pair of suction cups 21 is carried by their mounted blocks 38 on a cantilever 42 formed by a bent plate extending from a bracket 43 having a spindle 44 in a journal 45 on an arm 46, which arm is secured to the respective support shaft 19 so that the arm 46 is caused to swing by engagement of the respective pinion 24 with the rack 25 and, in the alternative, by the respective cam follower 26 engaging the cam track 27. It will be seen in FIG. 4 that the cam track has a portion 27X of increased width where each pinion 24 engages with the rack 25, so that each cam follower 26 will have the necessary freedom of movement along this portion of the cam track.

Figure 5:
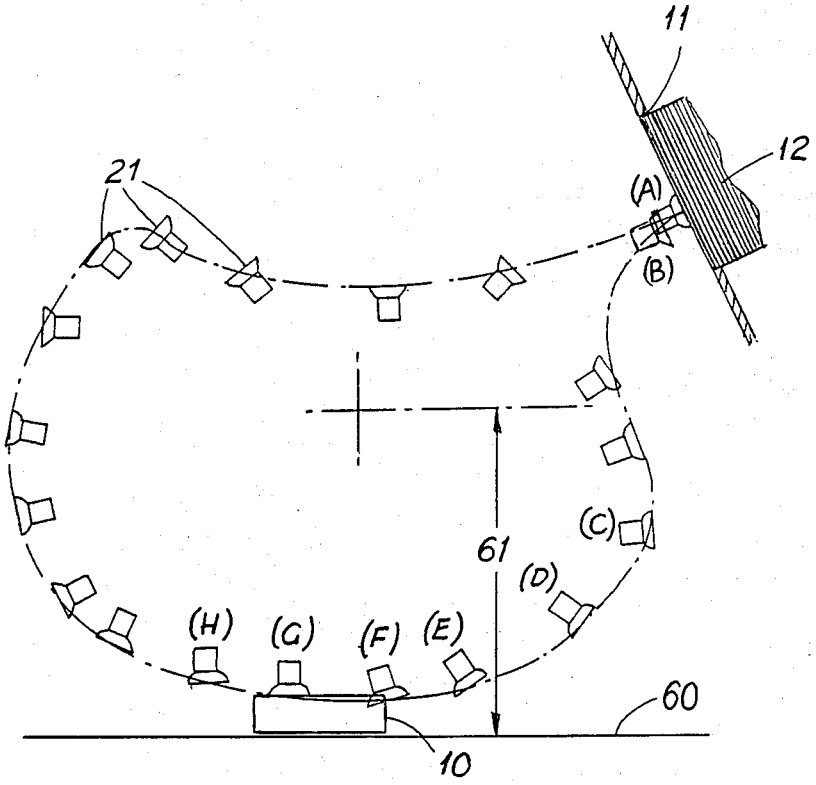
FIG. 5 is a diagram showing the path of one suction cup and indicating the disposition of the suction cup at various positions along the path.
Figure 6A:
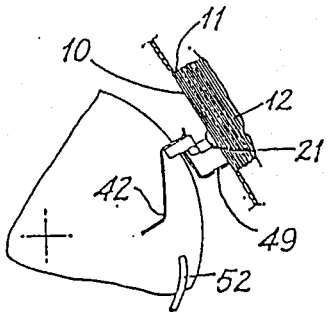
FIG. 6 (A) to (H) shows diagrammatically the sequence of positions (A) to (H) in FIG. 5 showing the suction cup from extracting of a collapsed sleeve carton from the discharge opening of the magazine to release of the opened sleeve carton between flights on the conveyor.
Figure 6B:
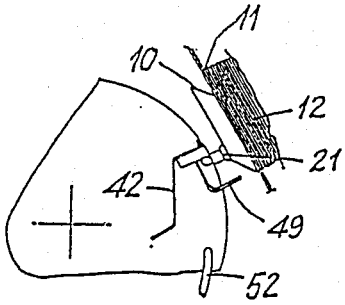
Figure 6C:
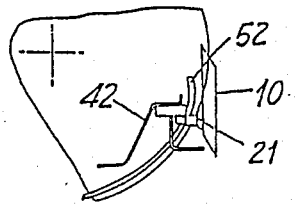
Figure 6D:
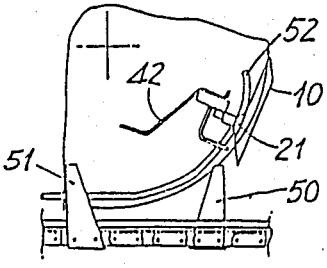
Figure 6E:
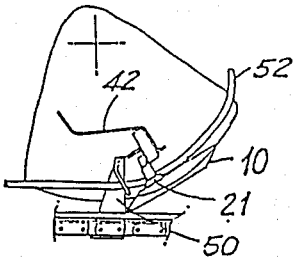
Figure 6F:
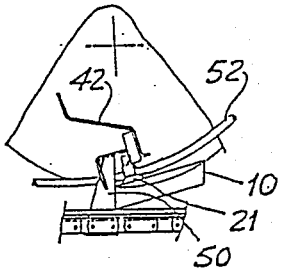
Figure 6G:
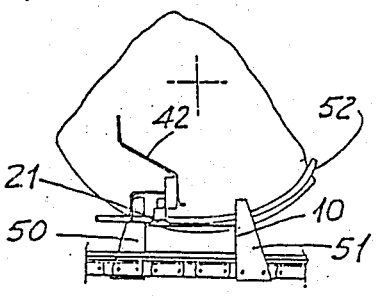
Figure 6H:
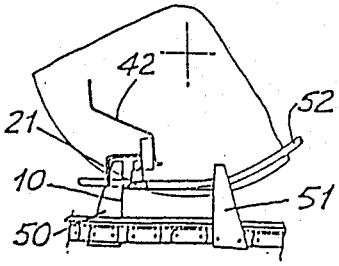

Each bracket 43 has a rocker arm 47 pivotally linked to a rocker arm 48 freely rotatable on the drive shaft 16, whereby as the respective arm 46 swings the suction cups 21 are orientated accordingly, and particularly as appropriate from positon (A) to position (H) is FIG. 5 along the path traced by the common centreline of the rims of each pair of suction cups, which together with six intermediate positions are shown in FIG. 6 (A) to (H) in relation to the attitute of a sleeve carton 10 fom the discharge opening 11 of the magazine 12 to release at the delivery station 13 on to the conveyor 14.

At postion (A) each set of suction cups 21 pushes slightly into the opening 11 of the magazine 12 to the actual "node point", to ensure adequate contact with the foremost sleeve carton 10 for suction then to hold the nearside of the carton and pull it from the magazine as the suction cups move away from the "node point". This causes the sleeve carton to open until the lower or leading corner or fold is about to be pulled free of the magazine, as shown at position (B). The carton then springs back towards its collapsed condition, as indicated at position (C), thus trusting its leading corner down towards the conveyor. Bent finger-like rods 49 mounted adjacent the suction cups 21 ensure that the leading corner of the carton cannot spring past the top of leading flights 50 on the conveyor 14 while passing through position (D), so that only at position (E) the leading corner of the sleeve carton first encounters the leading flights. A slightly greater relative speed of the suction cups 21 results in a pulling of the sleeve carton farther open again—see position F—until when the suction cups are about to be connected to atmosphere (by the vacuum control means 23) to release the carton, the carton has reached the fully open condition, as shown at position (G), abutted by trailing flights 51 on the conveyor. Guiding or stripping rods 52 ensure that the carton cannot spring out from between the flights 50, 51 when, as shown at position (H), the suction cups have been released from the carton.

Figure 2:
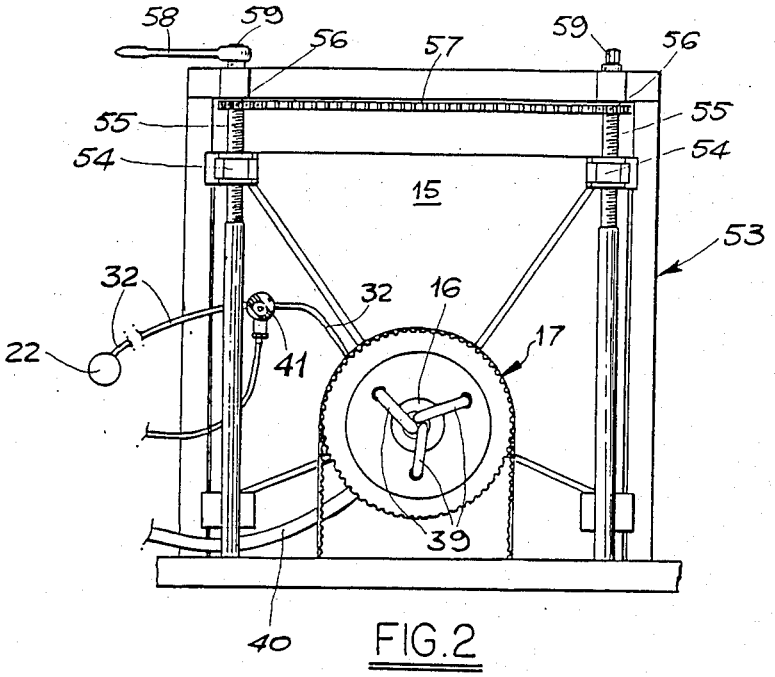
FIG. 2 is a rear elevation of the mechanism on a smaller scale than FIG. 1.

FIGS. 1 and 2 show the suport members 15 vertically adjustable in a frame 53 by means of captive nuts 54 on parallel screws 55 which are coupled together by sprockets 56 and a chain 57 for simultaneous rotation by means of a wrench 58 applied to either of a pair of hexagons 59 provided one on the upper end of each screw, for adjustment of the position of the rotary transfer mechanism in relation to the conveyor top surface 60 in accordance with the height of the fully open sleeve carton 10 on the conveyor. This height adjustment is also used when there is a change in the nominal height of cartons to be transferred.

Figure 7:
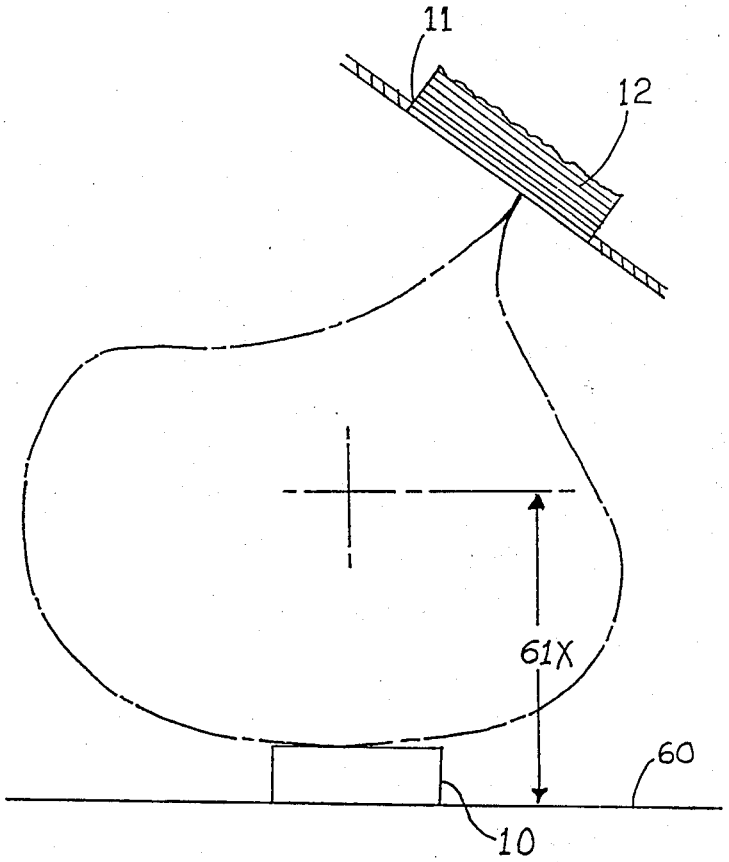
FIGS. 7 and 8 correspond to FIG. 5 but indicate how the suction cup path can be varied to suit different sizes of article and dispositions of magazine.
Figure 8:
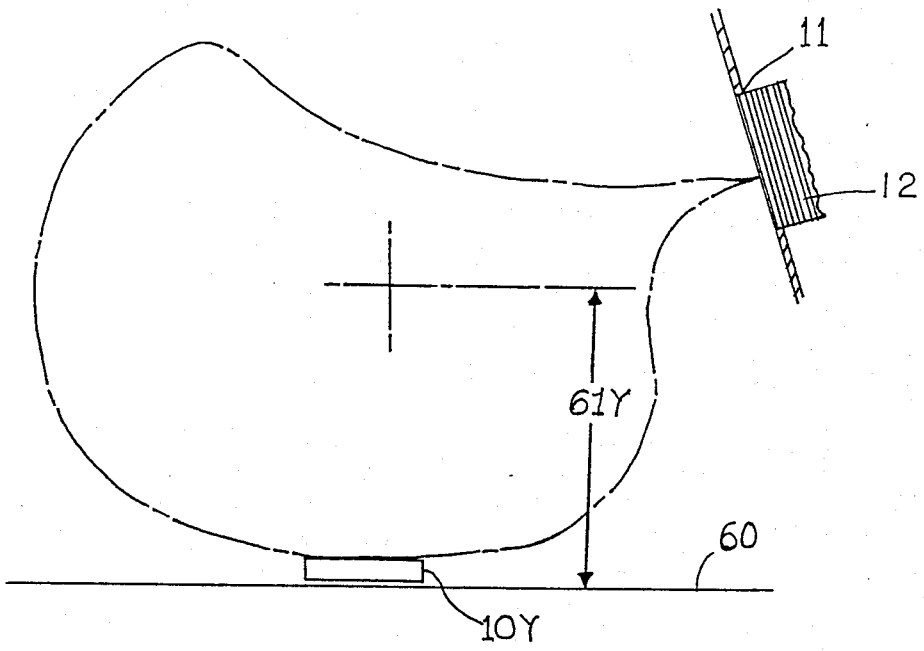

Such a change in nominal height may be accompanied by a change in nominal width of cartons, as is indicated in FIGS. 7 and 8, in which case a different location of the discharge opening 11 of the magazine 12 may be necessary, or advantageous. Thus, in FIG. 7 the carton 10X has both a greater height and a greater width, the latter calling for the magazine 12 being disposed higher up and with the discharge opening 11 nearer the horizontal, while in FIG. 8 the carton 10Y has both a lesser height and a lesser width, which enables the magazine to be disposed lower down and with the discharge opening near the vertical. In either case, the only change in the actual rotary transfer mechanism will be in the profile of the cam track 27 (not shown), because the arcuate rack 25 merely needs to be relocated on the support member 15 as appropriate to the higher or lower "node point". A comparison can be made of the respective heights 61, 61X, 61Y from the conveyor top surface 60 to the centre of the drive shaft 16 in FIGS. 5, 7 and 8 to get an indication of the small amount of height adjustment involved.

The extent of the arcuate rack 25 and the profile of the cam track 27 (except along the widened portion 27X) are such that a smooth blending is effected between the movements of the rotary transfer mechanism caused by the rack acting through the pinions 24 and the cam track 27 and enables the mechanism to be run at usefully high speeds, i.e., high throughput of cartons, with very low noise levels.

We claim:

1. A rotary transfer mechanism for transferring a flat article from a discharge opening of a magazine to a receiving station on a conveyor, comprising:

a support member;

a drive shaft rotatably mounted on said support member;

means for rotatably driving said drive shaft;

carrier means rotatable with said drive shaft;

at least one support shaft rotatable on said carrier means substantially parallel to said drive shaft whereby said support shaft orbits around said drive shaft;

vacuum means including a suction means connected to said support shaft for (1) positively engaging the article at the discharge opening of the magazine, (2) positively holding the article during transfer to the receiving station, and (3) releasing said article at said receiving station; and means for controlling the rotational disposition of the support shaft with respect to said carrier means, said controlling means including a pinion secured coaxially to the support shaft, an arcuate rack secured to the support member, a cam follower on an arm extending laterally from the support shaft and a cam track secured to the support member;

said arcuate rack being in such a position so as to act upon the pinion to create a partial path of the suction means with a node point at the discharge opening of the magazine and said cam track being of such an extent as to act upon the cam follower when the arcuate rack is not acting on the pinion with the profile of the cam track being such as to cause the suction means to move past the receiving station in the same direction as the conveyor with the article generally parallel to the conveyor.

2. A rotary transfer mechanism as in claim 1 wherein said conveyor further includes leading and trailing flights and an end loading station and said article is a sleeve carton including a leading corner fold and wherein the combined action of the means for rotatably driving the drive shaft nd the means for controlling the at least one support shaft is such that at the receiving station the suction means is moving in the same direction as the conveyor relatively at a slightly greater speed, whereby the relative movement between the suction means, holding one side of said sleeve carton, and leading flights on the conveyor, which flights are abutted by the leading corner fold of the sleeve carton, is such as to effect an opening of the sleeve carton which is substantially completed before the sleeve carton is abutted by said trailing flights on the conveyor to hold the sleeve carton in its fully open condition as it passes to and through said end-loading station.

3. A rotary transfer mechanism as in claim 1, wherein the arcuate rack is disposed radially outwards with respect to the orbital path of the at least one support shaft, and the pinion meshes directly with the arcuate rack.

4. A rotary transfer mechanism as in claim 1, wherein the cam follower is carried by the pinion offset from the common axis with the support shaft, whereby the pinion serves as the arm extending laterally from the support shaft.

5. A rotary transfer mechanism as in claim 1, wherein the cam track is continuous but is provided with an inoperative portion along which the cam follower passes with clearance when the rack is acting on the pinion.

6. A rotary transfer mechanism as in claim 1, wherein three support shafts are provided with two suction cups attached to each shaft.

7. A rotary transfer mechanism as in claim 6, wherein each pair of suction cups is mounted on a cantilever extending from a bracket having a spindle in a journal on an arm secured to the respective support shaft, so that the arm is caused to swing by engagement of the respective pinion with the rack as well as by the cam follower engaging the cam track, and each bracket has a rocker arm pivotally linked to a rocker arm freely rotatable on the drive shaft, whereby as the respective arm swings, the suction cups are oriented as appropriate at the discharge opening of the magazine and at the receiving station on the conveyor.

8. A rotary transfer mechanism as in claim 1, further including a frame, said support member being vertically adjustable in said frame for adjustment of the position of the rotary transfer mechanism in relation to the conveyor.

9. A rotary transfer mechanism as in claim 8, wherein the support member is adjustable by means of captive nuts on parallel screws which are coupled together by sprockets and a chain for simultaneous rotation.

10. A rotary transfer mechanism as in claim 9, wherein the upper end of at least one screw is provided with means for application of a wrench for effecting simultaneous rotation of the screws.

11. A rotary transfer mechanism as in claim 1; wherein said vacuum means further includes means for producing a vacuum, means for alternatively connecting said suction means with said vacuum producing means and means, on said means for controlling said at least one support shaft, for causing said suction means while connected with said vacuum producing means to contact an article at the discharge opening of said magazine, extract the article from the magazine and transfer the article to the receiving station where upon said suction means is connected with atmosphere to release said article to said receiving station.

* * * * *